US005178591A

United States Patent [19]

Lyons

[11] Patent Number: 5,178,591

[45] Date of Patent: Jan. 12, 1993

[54] STAIR STEPPER EXERCISE APPARATUS

[76] Inventor: Earl Lyons, 5541 Sikline, Littleton, Colo. 80127

[21] Appl. No.: 889,267

[22] Filed: May 28, 1992

[51] Int. Cl.[5] ..... A63B 22/04; A63B 22/06

[52] U.S. Cl. ..... 482/52; 482/57; 482/148

[58] Field of Search ..... 482/57, 62, 52, 53, 482/148, 79, 121, 122, 126

[56] References Cited

U.S. PATENT DOCUMENTS 4,602,781 7/1986 La Marsh et al. ..... 482/62
4,625,963 12/1986 Lancellotti ..... 482/62
4,934,688 6/1990 Lo ..... 482/53

*Primary Examiner*—Stephen R. Crow

*Attorney, Agent, or Firm*—Leon Gilden

[57] ABSTRACT

A stair stepper device having first and second step plates pivotally mounted relative to a central post includes a handlebar rod mounted to an upper distal end of the central post, with a first post including clamp members permitting selective securement to the handlebar post. The first post includes a second post orthogonally mounted to the first post, with a third post orthogonally oriented relative to the second post and parallel to the first post. A plurality of hook members selectively mount springs, pulleys or elastomeric loops to permit exercise of an individual's arms in association with the leg members. The apparatus is arranged to further include further resistant members to permit varied exercise relative to the stair stepper device.

4 Claims, 4 Drawing Sheets

FIG 6
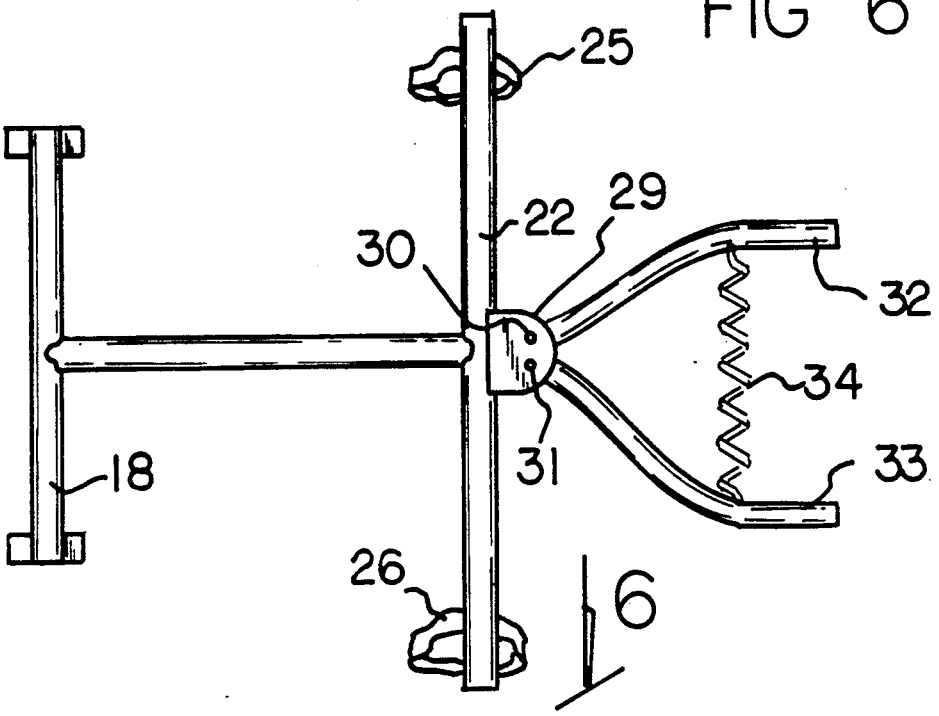
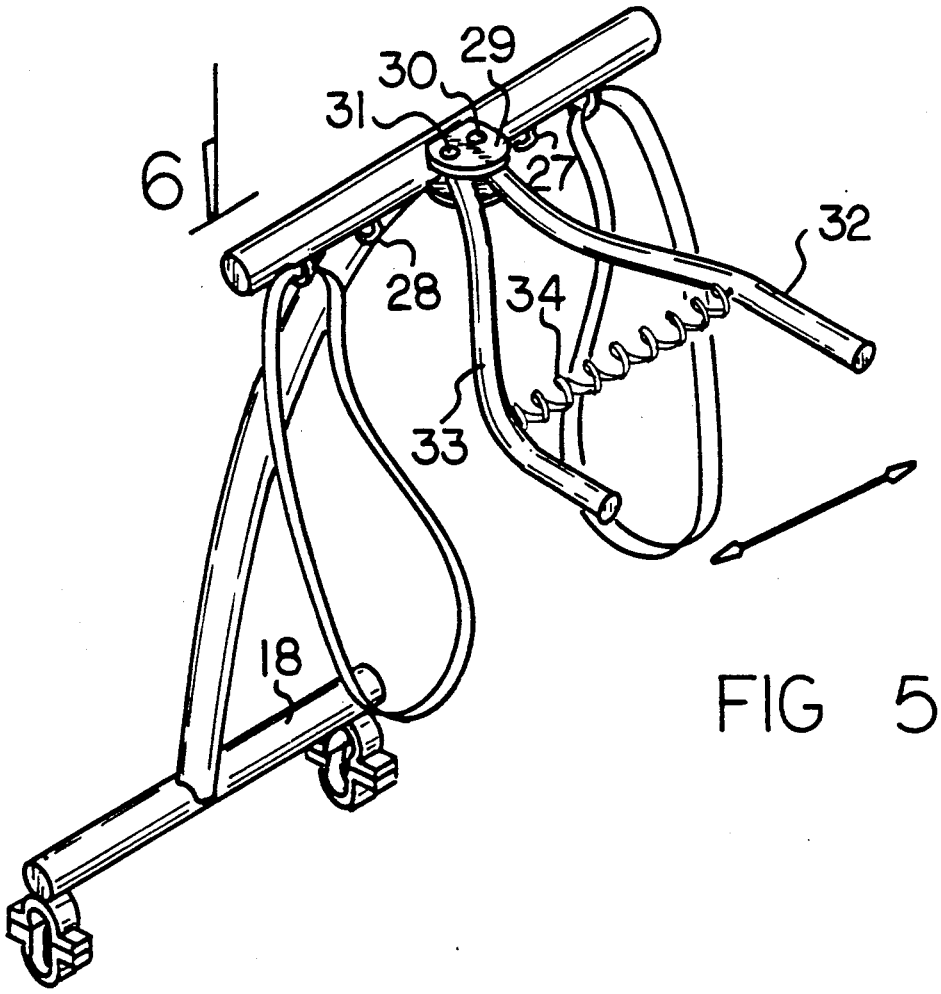
FIG 5

STAIR STEPPER EXERCISE APPARATUS

BACKGROUND OF THE INVENTION

1. Field of the Invention

The field of invention relates to stair stepper exercise apparatus, and more particularly pertains to a new and improved stair stepper exercise apparatus wherein the same is arranged to permit exercise of an individual's arm members in association with an individual's legs.

2. Description of the Prior Art

Stair stepper devices of various types have been utilized throughout the prior art, but are typically directed to the exercise of an individual's legs. To accommodate the individual's arm members in simultaneous exercise relative to the legs, the exercise apparatus of the instant invention sets forth an adjunct structure arranged for securement relative to the exercise stair stepper device of the invention.

Prior art stair stepper devices directed to exercise of an individual's leg members are set forth and exemplified in U.S. Pat. Nos. 4,726,581; 4,938,474; 3,592,466; and 4,958,830.

Accordingly, there remains a need for a new and improved stair stepper exercise apparatus as set forth by the instant invention which addresses both the problems of ease of use as well as effectiveness in construction in providing coordinated exercise to an individual's arms and legs in utilization of the stair stepper device and in this respect, the present invention substantially fulfills this need.

SUMMARY OF THE INVENTION

In view of the foregoing disadvantages inherent in the known types of stair stepper exercise apparatus now present in the prior art, the present invention provides a stair stepper exercise apparatus utilizing resistance bands spring cables or pulleys permitting the exercise of an individual's arms in conjunction with exercise of an individual's legs. As such, the general purpose of the present invention, which will be described subsequently in greater detail, is to provide a new and improved stair stepper exercise apparatus which has all the advantages of the prior art stair stepper exercise apparatus and none of the disadvantages.

To attain this, the present invention provides a stair stepper device having first and second step plates pivotally mounted relative to a central post including a handlebar rod mounted to an upper distal end of the central post, with a first post including clamp members permitting selective securement to the handlebar post. The first post includes a second post orthogonally mounted to the first post, with a third post orthogonally oriented relative to the second post and parallel to the first post. A plurality of hook members selectively mount spring cables or pulleys elastomeric loops to permit exercise of an individual's arms in association with the leg members. The apparatus is arranged to further include further resistant members to permit varied exercise relative to the stair stepper device.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stair stepper exercise apparatus which has all the advantages of the prior art stair stepper exercise apparatus and none of the disadvantages.

It is another object of the present invention to provide a new and improved stair stepper exercise apparatus which may be easily and efficiently manufactured and marketed.

It is a further object of the present invention to provide a new and improved stair stepper exercise apparatus which is of a durable and reliable construction.

An even further object of the present invention is to provide a new and improved stair stepper exercise apparatus which is susceptible of a low cost of manufacture with regard to both materials and labor, and which accordingly is then susceptible of low prices of sale to the consuming public, thereby making such stair stepper exercise apparatus economically available to the buying public.

Still yet another object of the present invention is to provide a new and improved stair stepper exercise apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of a modified aspect of the invention.

FIG. 6 is an orthographic view, taken along the lines 6—6 of FIG. 5 in the direction indicated by the arrows.

DESCRIPTION OF THE PREFERRED EMBODIMENT

Figure 1:
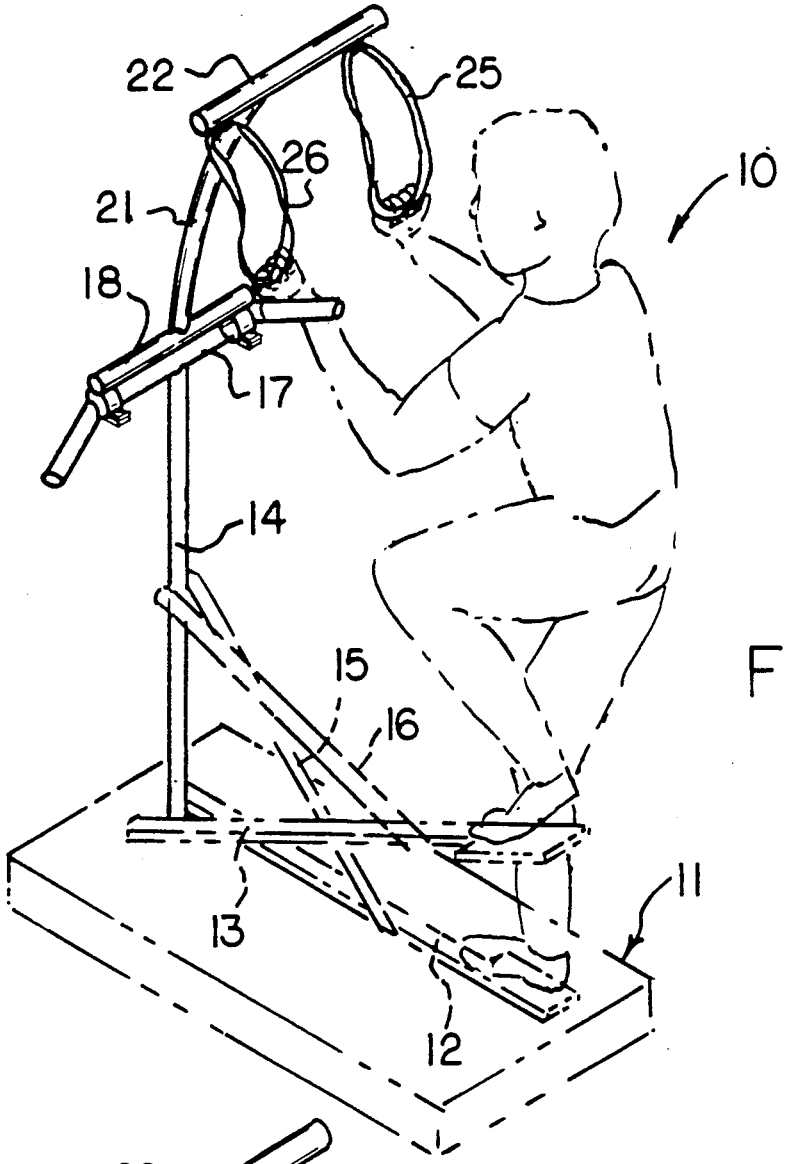
FIG. 1 is an isometric illustration of the instant invention.
Figure 2:
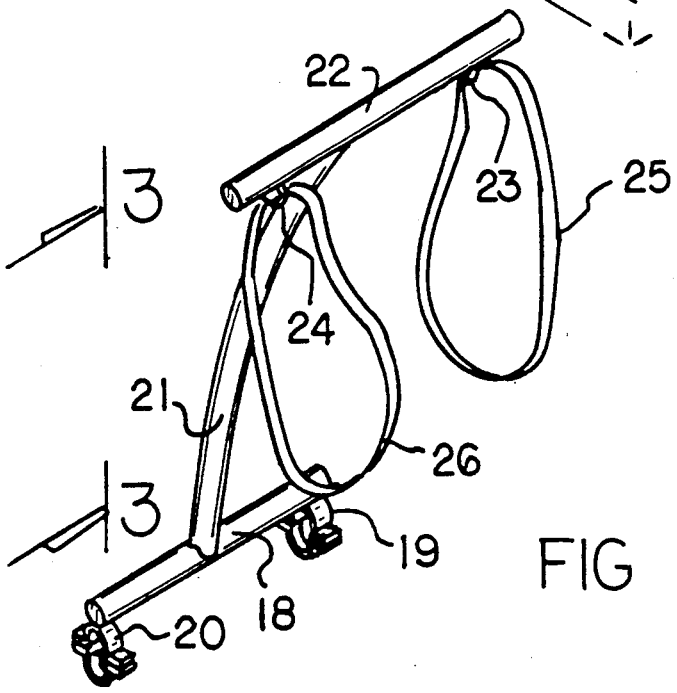
FIG. 2 is an isometric illustration of the adjunct structure utilized by the invention.
Figure 3:
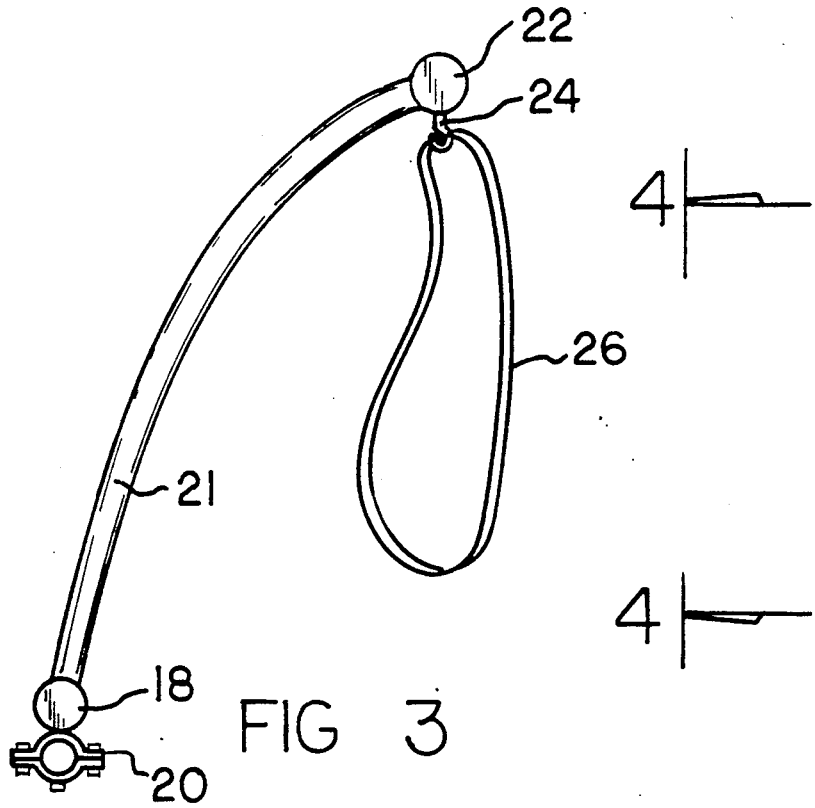
FIG. 3 is an orthographic view, taken along the lines 3—3 of FIG. 2 in the direction indicated by the arrows.

With reference now to the drawings, and in particular to FIGS. 1 to 8 thereof, a new and improved stair stepper exercise apparatus embodying the principles and concepts of the present invention and generally designated by the reference numeral 10 will be described.

Figure 4:
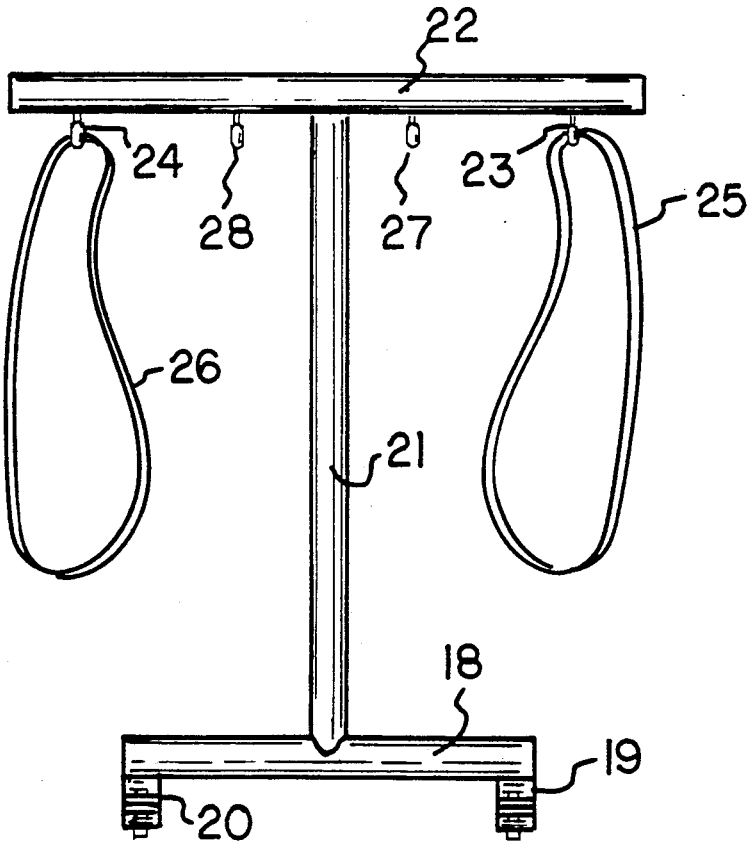
FIG. 4 is an orthographic view, taken along the lines 4—4 of FIG. 3 in the direction indicated by the arrows.

More specifically, the stair stepper exercise apparatus 10 of the instant invention essentially comprises a stair stepper device 11, as indicated in FIG. 1, having a base plate including a first step plate 12 and a second step plate 13 pivotally mounted by a central post 14 that in turn is secured to the base of the device 11. A first resistance member 15 and second resistance member 16 respectively mounted to the first and second step plates 12 and 13 and to the central post 14 permit resistance to the utilization of the step plates, in a manner known in the prior art. The central post 14 has a handlebar rod 17 orthogonally mounted to an upper distal end of the central post 14. A first post 18 having respective first and second clamps 19 and 20 secure the first post 18 to the handlebar rod 17 medially of the handlebar rod. A second post 21 integrally mounted to the first post 18 orthogonally thereto extends upwardly of the second post, with a third post 22 fixedly and orthogonally intersected by the second post, with the third post 22 parallel to the first post 18. First and second support hooks 23 and 24 mounted to bottom surfaces of the third post 22 on opposed sides of the second post 21 secure first and second spring cables pulley or elastomeric loops 25 and 26 thereto. In use, upon an individual pivotally displacing the first and second plates 12 and 13, an individual may simultaneously employ the first and second elastomeric loops 25 and 26 for exercise of the individual's arms. Further, as illustrated in FIG. 4, the use of a third support hook 27 between the first support hook 23 and the second post 21, and a fourth support hook 28 between the second support hook 24 and the second post 21 permit repositioning of the first and second loops 25 and 26 to provide for a varying angularity of the individual's arms during exercise of the arms.

Figure 7:
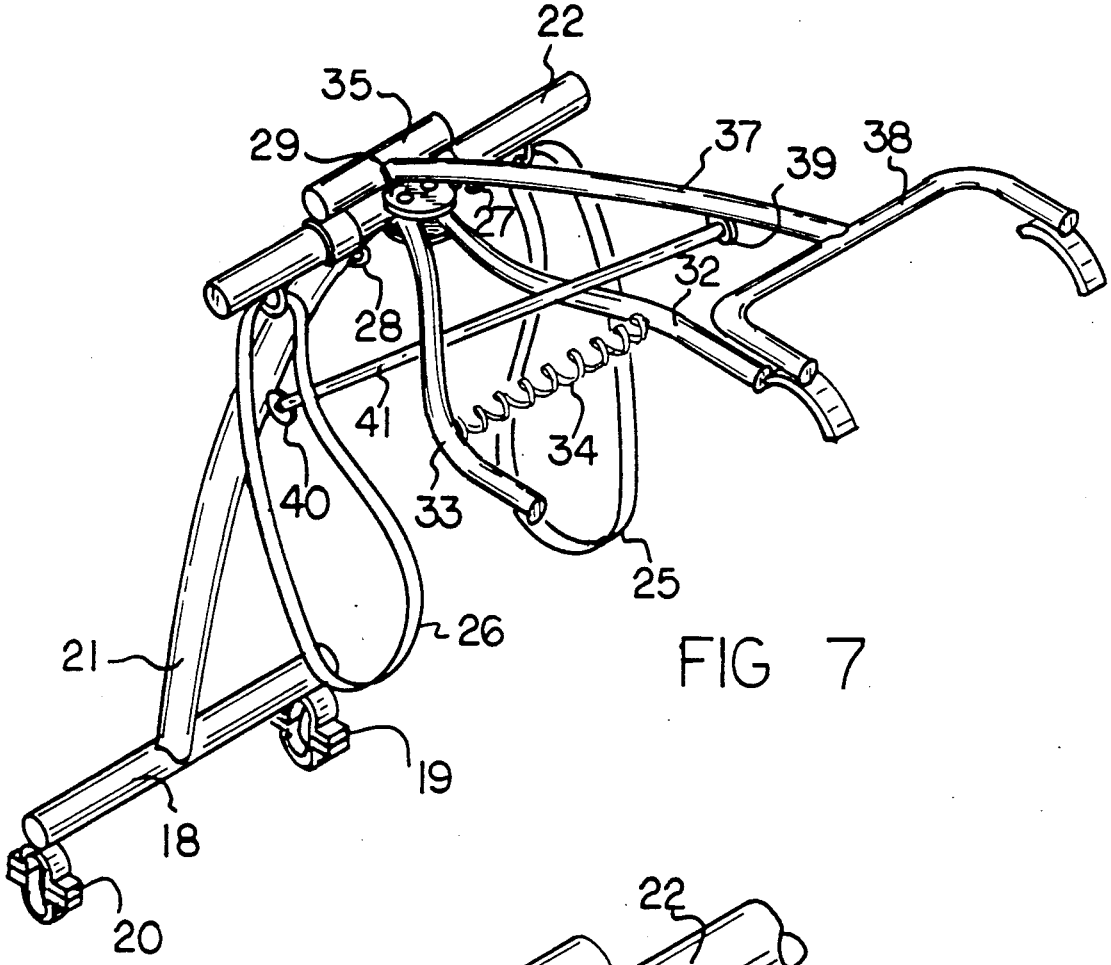
FIG. 7 is an isometric illustration of a yet further modified aspect of the invention.

The FIGS. 6 and 7 set forth the further use of spaced parallel flanges 29 integrally mounted medially of the third post 22 projecting forwardly of the third post and are arranged parallel relative to the first post 18. The parallel flanges 29 mount respective first and second axles 30 and 31 orthogonally between the flanges, with the first and second axles 30 and 31 pivotally mounting first and second lever arms 32 and 33 that in turn project forwardly of the flanges. The first and second lever arms 32 and 33 include a resistance spring 34 positioned therebetween, whereupon an individual during a stair stepping procedure may as an alternative effect compression of the first and second lever arms 32 and 33 together to provide for a varying arm exercise maneuver. If desired, to provide for clearance, the first post 18 may be rotated about the handlebar rod 17 by the loosening and subsequent tightening of the clamps 19 and 20.

Figure 8:
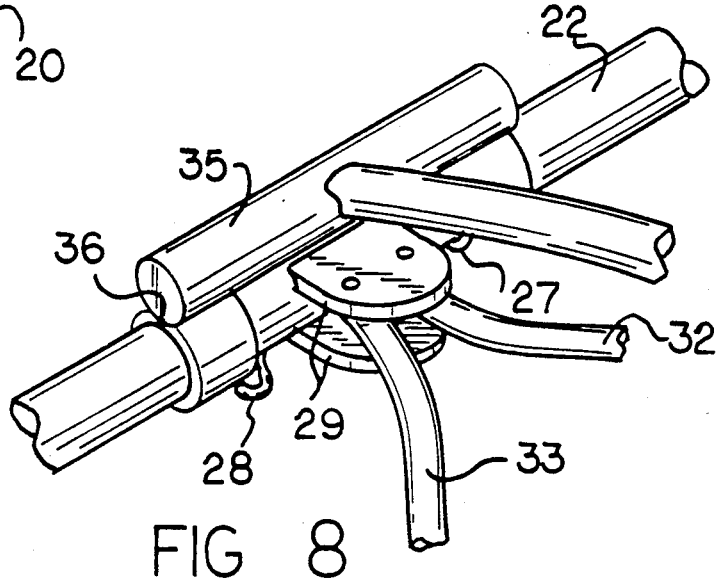
FIG. 8 is an isometric enlarged illustration of the mounting of the leg resistance pivot tube structure, as illustrated in FIG. 7.

The FIGS. 7 and 8 illustrate the further use in the invention of a pivot tube 35 pivotally mounted relative to the third post 22 above the flanges 29 about a pivot tube hinge pin 36. An arcuate lift tube 37 projects forwardly of the pivot tube 35 above and medially of the first and second lever arms 32 and 33. The lift tube 37 integrally and orthogonally mounts a U-shaped shoulder mount 38 having spaced legs parallel to the arcuate lift tube 37, with the spaced legs having arcuate shoulder mounts, with the shoulder mounts receiving the individual's shoulders therewithin. A first mount 39 mounted to a bottom surface of the lift tube 37 cooperates with a second mount 40 mounted to the second post 21 to secure an elastomeric resistance strap 41 therebetween. In this manner, additional resistance may be imposed upon an individual to exercise the individual's back, as well as the individual's legs during utilization of the first and second step plates 12 and 13, while simultaneously permitting the employment of the first and second elastomeric loops 25 and 26, or alternatively of the first and second lever arms 32 and 33 for the exercise of the individual's arms.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stair stepper exercise apparatus, comprising, an exercise device having a base plate, the base plate including a central support post, and first and second step plates pivotally mounted relative to the central post, and a handlebar rod orthogonally and integrally mounted to an upper distal end of the central post, and a first post, the first post including clamp means for securement of the first post to the handlebar rod, and a second post integrally and orthogonally mounted to the first post extending upwardly of the first post, and a third post integrally and orthogonally mounted to an upper distal end of the second post, the third post including first and second elastomeric loops positioned on opposed sides of the second post permitting simultaneous arm and leg exercise utilizing the stair stepper device.

2. An apparatus as set forth in claim 1 including a first support hook and a third support hook mounted to the third post relative to a first side of the second post, and a second support hook and a fourth support hook mounted to a second side of the second post relative to the first support hook and the second support hook, wherein the first support hook and the third support hook selectively secure the first elastomeric loop, and the second support hook and the fourth support hook selectively secure the second elastomeric loop.

3. An apparatus as set forth in claim 2 including parallel flanges integrally and medially mounted relative to the third post, with the parallel flanges arranged parallel relative to the first post, and a first axle and second axle orthogonally directed through the parallel flanges, with a first lever arm pivotally mounted relative to the first axle, and a second lever arm pivotally mounted to the second axle, with the first lever arm and the second lever arm projecting forwardly of the flanges and the third post, and a resistance spring positioned between the first lever arm and the second lever arm.

4. An apparatus as set forth in claim 3 including a pivot tube pivotally mounted relative to the third post adjacent the flanges, and the pivot tube pivotally mounted relative to the third post about a hinge pin, and an arcuate lift tube mounted orthogonally and medially of the pivot tube extending forwardly of the pivot tube, and above and medially of the first lever arm and the second lever arm, with the arcuate lift tube including a lift tube forward end spaced from the pivot tube, and the forward end having a U-shaped shoulder mount integrally mounted thereto, the arcuate lift tube including a first mount, and the second post including a second mount, and an elastomeric resistance strip mounted between the first mount and the second mount.

* * * * *